United States Patent [19]

Nagano

[11] Patent Number: 4,506,208

[45] Date of Patent: Mar. 19, 1985

[54] REFERENCE VOLTAGE PRODUCING CIRCUIT

[75] Inventor: Katsumi Nagano, Shimonoseki, Japan

[73] Assignee: Tokyo Shibaura Denki Kabushiki Kaisha, Japan

[21] Appl. No.: 538,891

[22] Filed: Oct. 4, 1983

[30] Foreign Application Priority Data

Nov. 22, 1982 [JP] Japan ..... 57-205060

[51] Int. Cl.[3] ..... G05F 3/20

[52] U.S. Cl. ..... 323/314; 307/297; 330/257

[58] Field of Search ..... 323/312–316; 307/296 R, 297; 330/257, 288, 296, 297

[56] References Cited

U.S. PATENT DOCUMENTS

| | | | |
|---|---|---|---|
| 3,617,859 | 11/1971 | Dobkin et al. | 323/313 |
| 4,071,813 | 1/1978 | Dobkin | 323/313 X |
| 4,263,519 | 4/1981 | Schadz, Jr. | 323/314 X |
| 4,317,054 | 2/1982 | Caruso et al. | 323/313 X |
| 4,319,180 | 3/1982 | Nagano | 323/313 |
| 4,447,784 | 5/1984 | Dobkin | 323/313 X |

OTHER PUBLICATIONS

Gray et al., "Analysis and Design of Analog Integrated Circuits," pp. 254–261.

*Primary Examiner*—Peter S. Wong
*Attorney, Agent, or Firm*—Finnegan, Henderson, Farabow, Garrett & Dunner

[57] ABSTRACT

A reference voltage producing circuit includes a voltage signal producing circuit, a differential amplifier and an emitter follower circuit. The voltage signal producing circuit includes a first series circuit for producing a first voltage signal, a second series circuit for producing a second voltage signal and a constant current source for controlling the first and second series circuits. The differential amplifier operates so as to make the levels of the first and second voltage signals equal to each other, and controls the transistor forming the emitter follower circuit. The emitter of the transistor forming the emitter follower circuit produces a reference voltage.

6 Claims, 4 Drawing Figures

REFERENCE VOLTAGE PRODUCING CIRCUIT

BACKGROUND OF THE INVENTION

This invention relates to a reference voltage producing circuit fabricated in an integrated circuit and, more particularly, to a reference voltage producing circuit fabricated in a bipolar IC.

A known circuit, called a band-gap reference circuit, has been used for the reference voltage producing circuit in fabrication of the bipolar IC. FIG. 1 shows a circuit diagram for illustrating the principles of the band-gap reference circuit. In FIG. 1, the circuit includes an NPN transistor $Q_1$ in which the collector-emitter path is connected between the reference voltage output terminals ⊕ and ⊖ through resistors $R_1$ and $R_2$ and the base electrode is connected to the collector, and an NPN transistor $Q_2$ in which the emitter-collector path is connected between the reference voltage output terminals ⊕ and ⊖ via a resistor $R_3$ and the base electrode is connected to the collector. An operational amplifier 1 is connected at the inverting input terminal (−) to a node a between the resistors $R_1$ and $R_2$, at the noninverting input terminal (+) to a node b between the resistor $R_3$ and the collector of the transistor $Q_2$, and at the output terminal to the reference voltage output 2erminal (+) and to a common junction between the resistors $R_1$ and $R_3$.

In FIG. 1, the operational amplifier 1 operates so that the potential levels at nodes a and b are equal to each other. If the resistances of the resistors $R_1$ and $R_3$ are set to be equal to each other and the emitter area of the transistor $Q_1$ is set to be larger than that of the transistor $Q_2$, the base-emitter voltage $V_{BE1}$ of the transistor $Q_1$ becomes smaller than the base-emitter voltage $V_{BE1}$ of the transistor $Q_2$ and a difference voltage of "$V_{BE2}$−-$V_{BE1}$" appears across the resistor $R_2$. More specifically, if $V_{BE2}$ is 0.7 V, the base-emitter voltage $V_{BE1}$ of the transistor $Q_1$ is smaller than 0.7 volts and 0.7 volts is applied to the non-inverting input terminal (+) of the operation amplifier 1. If a resistance ratio of the resistance of the resistor $R_1$ to that of the resistor $R_2$ is so selected that the voltage drop across the resistor $R_1$ is about 0.7 volts, a reference or output voltage $V_{OUT}$ of about 1.2 volts appears between the reference voltage output terminals ⊕ and ⊖, since the voltage levels at the input terminals (+) and (−) of the operational amplifier 1 are equal to each other.

The circuit of FIG. 1 provides a reference voltage or an output voltage $V_{OUT}$ with a small temperature coefficient, but has the following defects. In the operational amplifier 1, the switching operation is performed at a high speed, so that the reference voltage $V_{OUT}$ has a pulsative wave form which includes an AC component. Therefore, it is necessary to provide a capacitor for phase compensation in the operational amplifier in order to prevent the operational amplifier from oscillating due to this AC component. The capacitance of this phase compensation capacitor is small, 30 pF or so. However, this capacitor creates a problem when this capacitor is fabricated into an integrated circuit, because it needs a large area on the chip. That is, this capacitor hinders the improvement of integration density.

SUMMARY OF THE INVENTION

Accordingly, an object of the present invention is to provide a reference voltage producing circuit suitable for IC fabrication which can produce a reference voltage with a small temperature coefficient and does not require a phase compensation capacitor.

The reference voltage producing circuit according to the present invention comprises a voltage signal producing circuit having a first series circuit which includes a first transistor, a first resistor and a second resistor connected in series between the first and second terminals of a power supply source with one end of the collector-emitter path of the first transistor connected to the first terminal, a second series circuit which includes a second transistor and a third resistor connected in series between the first and second terminals with one end of the collector-emitter path of the second transistor connected to the first terminal, with the base electrode thereof connected to the base electrode of the first transistor, and a first constant current source connected between the first terminal and the base electrode of the second transistor for supplying a constant current to the base electrodes of the first and second transistors, a first voltage signal being produced on a node between the first and second resistors and a second voltage signal being produced on a node between the second transistor and the third resistor, a differential amplifier which is supplied with the first and second voltage signals, and an emitter follower circuit which is connected between the base electrode of the second transistor and the second terminal, and is controlled by the output signal of the differntial amplifier to produce the reference voltage at a constant level.

DETAILED DESCRIPTION OF THE PREFERRED EMBODIMENTS

Figure 1:
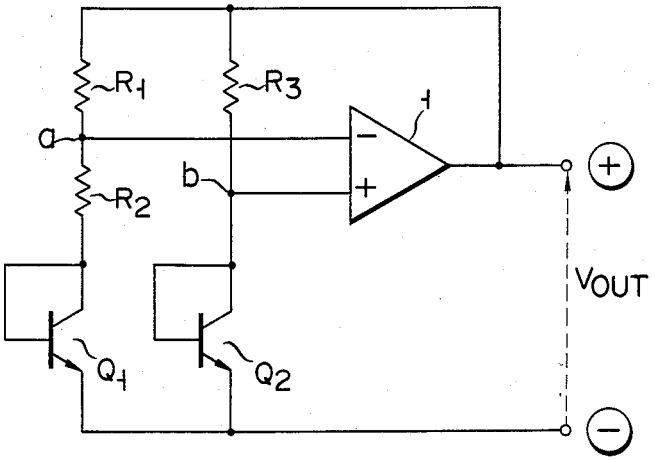
FIG. 1 PRIOR ART
FIG. 1 shows a block diagram of a conventional reference voltage producing circuit.
Figure 2:
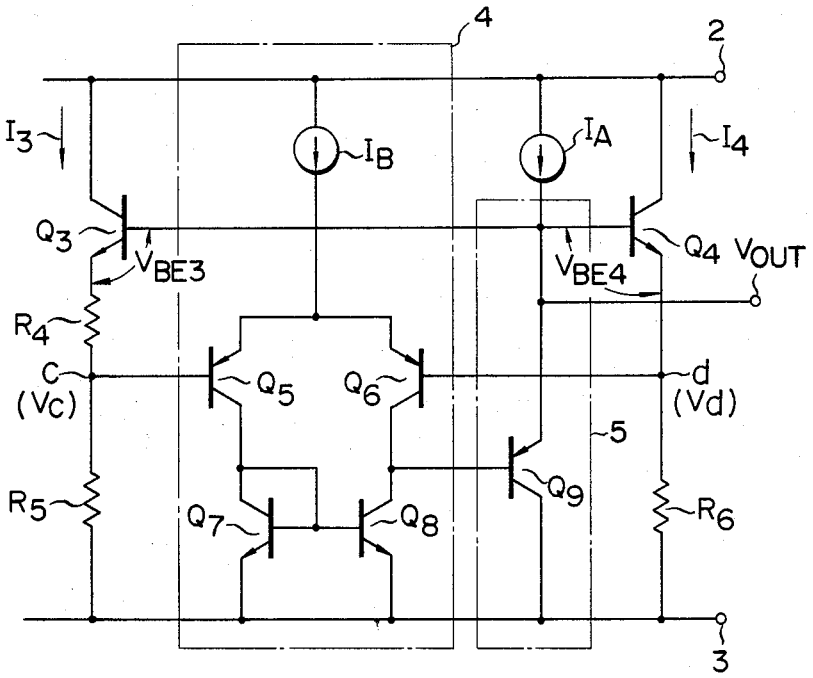
FIG. 2 is a circuit diagram of an embodiment of a reference voltage producing circuit according to the present invention.

In FIG. 2, first and second series circuits are connected between a positive potential terminal 2 and a negative potential terminal 3 which are connected to a DC power supply source not shown. The first series circuit includes a first NPN transistor $Q_3$, a first resistor $R_4$, and a second resistor $R_5$ connected in series. The first transistor $Q_3$ is connected at the collector to the positive potential terminal 2. The second series circuit includes a second NPN transistor $Q_4$ and a third resistor $R_6$ connected in series. The collector of the second transistor $Q_4$ is connected to the positive potential terminal 2. The first and second transistors $Q_3$ and $Q_4$ are interconnected at the base electrodes. A first constant current source $I_A$ is connected between the base electrodes of the first and second transistors and the positive potential terminal 2. The first and second series circuits and the first constant current source $I_A$ cooperate to form a voltage signal producing circuit. A first voltage signal $V_c$ is derived from a node c between the first resistor $R_4$ and the second resistor $R_5$. A second voltage signal $V_d$ is derived from a node d between the second transistor $Q_4$ and the third resistor $R_6$. A differential amplifier 4 comprises a first PNP differential input transistor $Q_5$, a second PNP differential input transistor $Q_6$, a second constant current source $I_B$ and a current mirror circuit. The second constant current source $I_B$ is connected between the positive potential terminal 2 and the emitters of the transistors $Q_5$ and $Q_6$. The first voltage signal $V_c$ is supplied to the base electrode of the transistor $Q_5$ and the second voltage signal $V_d$ is supplied to the base electrode of the transistor $Q_6$. The current mirror circuit includes a fourth NPN transistor $Q_7$ which is connected at the collector to the collector of the first differential input transistor $Q_5$, at the emitter to the negative potential terminal 3 and at the base electrode to the collector thereof, and a fifth NPN transistor $Q_8$ which is connected at the collector to the collector of the second differential input transistor $Q_6$, at the emitter to the negative potential terminal 3 and at the base electrode to the base electrode of the fourth transistor $Q_7$. An emitter follower circuit 5 includes a third PNP transistor $Q_9$ which is connected at the emitter to the base electrode of the second transistor $Q_4$, at the collector to the negative potential terminal 3, and at the base electrode to the collector of the second differnetial input transistor $Q_6$. The emitter of this transistor $Q_9$ is connected to a reference voltage output terminal $V_{OUT}$.

The operation of the circuit of FIG. 2 will now be described. In the figure, the first to third resistors $R_4$ to $R_6$ have resistances $R_4$ to $R_6$, respectively. The first and second voltage signal $V_c$ and $V_d$ are used for the input signals to the differential amplifier 4. The current of the first and second constant current sources $I_A$ and $I_B$ are denoted by $I_A$ and $I_B$, respectively. The base potential levels of the first and second transistors $Q_3$ and $Q_4$ are equal to each other. The differential amplifier 4 operates to make the input signals $V_c$ and $V_d$ equal to each other. Therefore, the sum of the voltage $V_{BE3}$ between the base electrode and emitter of the transistor $Q_3$ and the voltage drop across the resistor $R_4$ is equal to the voltage $V_{BE4}$ between the base and emitter of the transistor $Q_4$. Thus, the following relations exist:

$$V_{BE3}+R_4 \cdot I_3=V_{BE4} \quad (1)$$

$$V_c=V_d \quad (2)$$

where $I_3$ is a collector current of the transistor $Q_3$. It is assumed that the grounded amplification factor $\alpha$ of each of the transistor $Q_3$ and $Q_4$ is "1", and the base current of each of the transistor $Q_5$ and $Q_6$ is "0". Then, the current flowing through the resistor $R_5$ is $I_3$, which is equal to the collector current of the transistor $Q_3$, and the current flowing through the resistor $R_6$ is $I_4$, which is equal to the collector current of the transistor $Q_4$. Therefore, the levels of the $V_c$ and $V_d$ are shown by equations (3) and (4)

$$V_c=R_5 \cdot I_3 \quad (3)$$

$$V_d=R_6 \cdot I_4 \quad (4)$$

If the resistance $R_5$ is n (n is larger than 1) times the resistance $R_6$, the following equation (5) exists:

$$R_5=n \cdot R_6 \quad (5)$$

Therefore, rearranging the equations (3) to (5), we have $$I_3=(1/n) \cdot I_4 \quad (6)$$

In an active mode, a characteristic of a transistor is given by the diode equation (7).

$$V_{BE}=V_T \cdot l_n(I_c/I_s) \quad (7)$$

where $V_T$: Thermal voltage (about 26 mV at 300° K.)
$I_c$: Collector current
$I_s$: Reverse saturation current.

Substituting the equation (7) into the equation (1), we have the equation (8)

$$V_T \cdot l_n(I_3/I_s)+R_4 \cdot I_3=V_T \cdot l_n(I_4/I_s) \quad (8)$$

Rearranging the equations (6) and (8) with respect to the currents $I_3$ and $I_4$, we have $$I_3=(1/n) \cdot I_4=(V_T/R_4) \cdot l_n n \quad (9)$$

Levels $V_c$ and $V_d$ of the input signals $V_c$ and $V_d$ to the differential amplifier 4 are given by the equation (10)

$$V_c=V_d=(R_5/R_6) \cdot V_T l_n n \quad (10)$$

The voltage level of the reference voltage $V_{OUT}$ is the sum of the base-emitter voltage $V_{BE4}$ of the transistor $Q_4$ and the input signal $V_d$, and is expressed by $$V_{OUT}=V_{BE4}+(R_5/R_4) \cdot V_T l_n n \quad (11)$$

The second term on the right side of the equation (11) indicates a voltage generally noted as $\Delta V_{BE}$ and has a positive temperature coefficient. $V_{BE4}$ has a negative temperature coefficient. If the reference voltage $V_{OUT}$ is set to be equal to $V_{go}$ (an energy band gap voltage of silicon at an absolute temperature 0° K.), the temperature coefficient of the reference voltage $V_{OUT}$ is minimized and the level of $V_{OUT}$ is expressed by $$V_{OUT}=V_{BE4}+\Delta V_{BE}=V_{go} \quad (12)$$

If a ratio of the resistance $R_5$ and $R_6$ and an emitter area ratio of the transistors $Q_3$ and $Q_4$ are selected so as to satisfy the equation (12), a temperature coefficient of the reference voltage $V_{OUT}$ may be minimized. In this embodiment, there is no need for provision of a phase compensation capacitance for preventing the oscillation of the circuit to produce the reference voltage $V_{OUT}$. Because of this feature, this embodiment is suitable for IC fabrication.

An open loop gain is the most important factor in stabilizing the operation of the reference voltage producing circuit according to the present invention. An open loop gain for an AC component is the product of a gain of the differential amplifier 4 and a gain of the emitter follower circuit 5. The gain G of the differential amplifier 4 is given by $G=gm \cdot r_o$, where gm is a mutual conductance of each of the transistor $Q_5$ and $Q_6$, and $r_o$ is an output impedance of each of the transistors $Q_5$ and $Q_6$. The gain of the emitter follower circuit 5 is "1" and hence the emitter follower circuit 5 does not contribute to the open loop gain of the operational amplifier 4. Accordingly, an open loop gain Go of FIG. 2 is expressed by the eqaution (13)

$$Go=gm \cdot r_o=(I_B/2V_T) \cdot r_o \quad (13)$$

Figure 3:
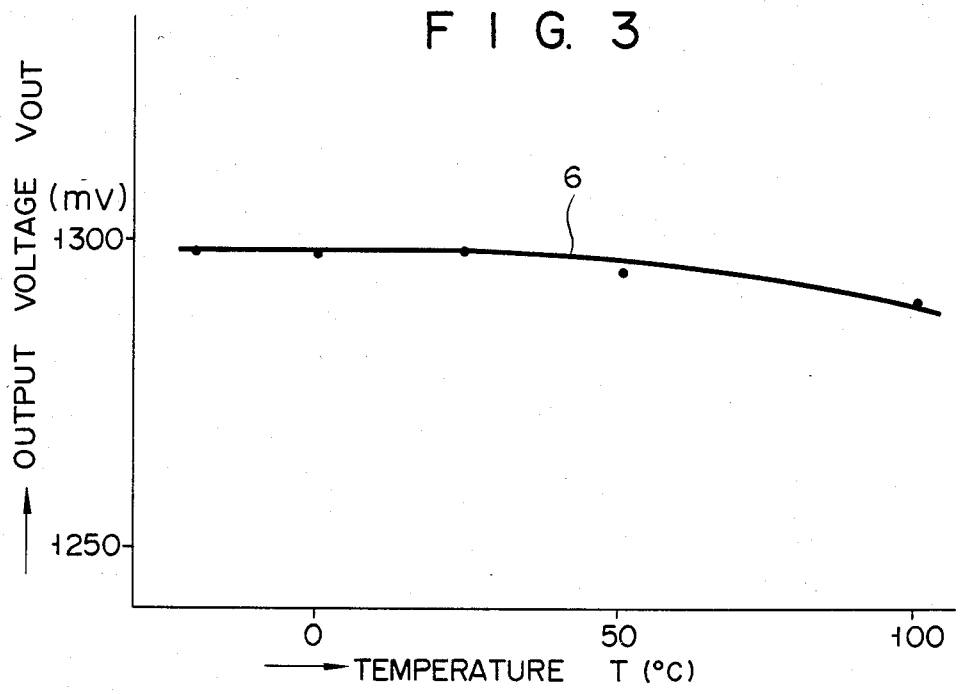
FIG. 3 shows a graph illustrating the relationship between the reference voltage and temperature in the circuit in FIG. 2.

An experimental circuit corresponding to FIG. 2 circuit will now be described. In the experimental circuit, the resistance $R_4$ is 5.9 kilo ohms, the resistance $R_5$ is 55 kilo ohms and the resistance $R_6$ is 5.5 kilo ohms. A resistor of 75 kilo ohms (not shown) which serves as the first constant current source $I_A$ is connected between the base electrodes of the transsitors $Q_3$ and $Q_4$ and the positive input terminal 2. A resistor of 150 kilo ohms (not shown) which serves as the second constant current source $I_B$ is connected between the emitters of the transistors $Q_5$ and $Q_6$ and the positive input terminal 2. 2 V is applied to the positive potential terminal 2 and 0 V is applied to the negative potential terminal 3. In the experimental circuit thus constructed, $I_B$ was 5 $\mu$A, $V_T$ was 26 mV and $r_o$ was 100 kilo ohms, and the open loop gain Go was approximately 9.6. A temperature characteristic of the reference voltage $V_{OUT}$ was measured under when $I_3=10\mu A$, $I_4=100\ \mu A$, $R_5/R_6=n=10$, and $V_{OUT}=1.3$ volts. The temperature characteristic thus obtained is depicted graphically in line 6 in FIG. 3. As seen from FIG. 3, a temperature coefficient TC of the characteristic line 6 is $-51$ ppm/°C. which is excellent. Further, the output voltage $V_{OUT}$ produced from the experimental circuit does not contain an oscillating component, and is very stable.

Figure 4:
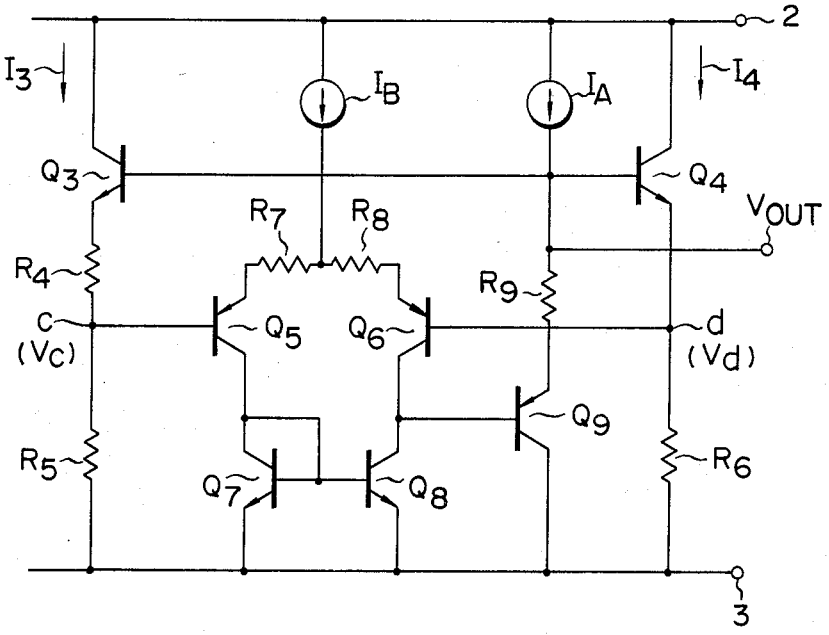
FIG. 4 is a circuit diagram of another embodiment of a reference voltage producing circuit according to the present invention. .

The open loop gain Go can be minimized by setting the current value $I_B$ of the second constant current source $I_B$ at a small value. The mutual conductance gm of each of the transistors $Q_5$, $Q_6$ and $Q_9$ can be made small by inserting emitter resistors $R_7$, $R_8$ and $R_9$ into the emitters of these transistors in the manner shown in FIG. 4, further minimizing the open loop gain Go.

What is claimed is:

1. A reference voltage producing circuit comprising:

a voltage signal producing circuit having a first series circuit which includes a first transistor, a first resistor and a second resistor connected in series between the first and second terminals of a power supply source with one end of the collector-emitter path of said first transistor connected to said first terminal, a second series circuit which includes a second transistor and a third resistor connected in series between said first and second terminals with one end of the collector-emitter path of said second transistor connected to said first terminal, with the base electrode thereof connected to the base electrode of said first transistor, and a first constant current source connected between said first terminal and the base electrode of said second transistor for supplying a constant current to the base electrodes of said first and second transistors, a first voltage signal being produced on a node between said first and second resistors and a second voltage signal being produced on a node between said second transistor and said third resistor;

an differential amplifier which is supplied with said first and second voltage signals; and an emitter follower circuit which is connected between said base electrode of said second transistor and said second terminal, and is controlled by the output signal of said differential amplifier to produce said reference voltage at a constant level.

2. A reference voltage producing circuit according to claim 1, wherein said differential amplifier comprises:

a first differential input transistor which receives at the base electrode said first voltage signal;

a second differential input transistor which receives at the base electrode thereof said second voltage signal;

a second constant current source which is connected between said first terminal and the emitters of said first and second differential input transistors; and a current mirror circuit connected between the collectors of said first and second differential input transistors and said second terminal.

3. A reference voltage producing circuit according to claim 2, wherein said emitter follower circuit comprises a third transistor which is connected at the collector-emitter path between said base electrodes of said first and second transistors, the base electrode thereof being connected to the output of said differential amplifier for producing said reference voltage from the emitter of said third transistor.

4. A reference voltage producing circuit according to claim 2, wherein said current mirror circuit comprises a fourth transistor which is connected at the collector-emitter path between the collector of said first differential input transistor and said second terminal and at the base electrode to the collector thereof; and a fifth transistor which is connected at the collector-emitter path between the collector of said second differential input transistor and said second terminal and at the base electrode to the base electrode of said fourth transistor; the collector of said fifth transistor being connected to said emitter follower circuit.

5. A reference voltage producing circuit according to claim 2, wherein said differential amplifier circuit further includes a fourth resistor connected between the emitter of said first differential input transistor and said second constant current source; and a fifth resistor connected between the emitter of said second differential input transistor and said second constant current source.

6. A reference voltage producing circuit according to claim 3, wherein said emitter follower circuit further includes a sixth resistor connected between the emitter of said third transistor and the base electrode of said second transistor, said reference voltage being derived from a node between the base electrode of said second transistor and said sixth resistor.

* * * * *